US006339989B1

(12) United States Patent
Fujimoto et al.

(10) Patent No.: US 6,339,989 B1
(45) Date of Patent: Jan. 22, 2002

(54) INK FOUNTAIN WITH TWO-POSITION TRAY

(75) Inventors: Shinichi Fujimoto; Teruaki Kihara, both of Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/538,742

(22) Filed: Mar. 30, 2000

(30) Foreign Application Priority Data

Aug. 19, 1999 (JP) ..... 11-232836
Aug. 19, 1999 (JP) ..... 11-232837

(51) Int. Cl.[7] ..... A41F 31/02; A41F 31/00
(52) U.S. Cl. ..... 101/367; 101/365; 101/350.1
(58) Field of Search ..... 101/350.1, 350.6, 101/363–367, 148, 207–210

(56) References Cited

U.S. PATENT DOCUMENTS 5,327,830 A * 7/1994 Gelinas et al. ..... 101/363
5,481,974 A * 1/1996 Sarazen et al. ..... 101/363
5,979,321 A * 11/1999 Koppelkamm et al. ..... 101/363

FOREIGN PATENT DOCUMENTS

| | | |
|---|---|---|
| DE | 195 30 958 | 8/1995 |
| EP | 0 508 031 | 10/1992 |
| EP | 0 850 762 | 7/1998 |
| JP | 57-13253 | 3/1982 |
| JP | 6-55728 | 3/1994 |

OTHER PUBLICATIONS

Copy of Japanese Patent Office Action for Japanese Patent Application No. HEI 11–232836 dated Jan. 31, 2000 including translation.

Copy of European Patent Office Communication, including European Search Report, for corresponding European Patent Application No. 00302287 dated Nov. 9, 2000.

* cited by examiner

*Primary Examiner*—Kimberly L. Asher
(74) *Attorney, Agent, or Firm*—Armstrong, Westerman, Hattori, McLeland & Naughton, LLP

(57) ABSTRACT

The present invention relates to an ink supplying apparatus equipped with an ink tray capable of improving the productivity based upon the labor-saving of an cleaning operation and the shortening of a preparatory time at ink replacement or the like in a printing press, with the ink tray being desirably attachable/detachable to enhance the operational efficiency. In front of an ink fountain, there is provided a fixing device which, for fixing an ink tray in the interior of the ink fountain, presses a bracket of the ink tray against a stopping section situated in the ink fountain. The fixing device is made up of a supporting member placed under a mounting plane of the bracket, a rotating member made to be rotatable in a plane substantially perpendicular to a cross direction of the apparatus in a state where its one end portion is supported by the supporting member, a pressing member provided on the rotating member for pressing the bracket in a state where the rotating member rotates upwardly so that the ink tray is fixed in the ink fountain, and an arresting member for arresting the rotation of the rotating member when the pressing member presses the bracket.

7 Claims, 13 Drawing Sheets

20: INK FOUNTAIN ROLLER
22: SIDE PLATE
23: INK FOUNTAIN
30: INK TRAY
35: FIXING PIN
40: PRESSER (FIXING DEVICE)
41: FIXING SCREW (PRESSING MEANS)
42: LEVER (ROTATING MEMBER, ENGAGING MEMBER)
47: BRACKET (SUPPORTING MEMBER)
47a: ELONGATED HOLE

2: INK SUPPLYING APPARATUS
20: INK FOUNTAIN ROLLER
21a: STEP (STOPPING SECTION)
22: SIDE PLATE
23: INK FOUNTAIN
30: INK TRAY
36: BRACKET

30: INK TRAY
35: FIXING PIN
36: BRACKET

21a: STEP (STOPPING SECTION)
22a: STEP (STOPPING SECTION)
30: INK TRAY
36: BRACKET 43a, 44a : CLAW (HOOKING MEMBER CONSTITUTING ARRESTING MEANS)

46: PIN (HOOKED MEMBER CONSTITUTING ARRESTING MEANS)

47: BRACKET (SUPPORTING MEMBER)

47a: ELONGATED HOLE

36: BRACKET

40: PRESSER (FIXING DEVICE)

41 : FIXING SCREW (PRESSING MEANS)

42: LEVER (ROTATING MEMBER, ENGAGING MEMBER)

41 : FIXING SCREW (PRESSING MEANS)

42: LEVER (ROTATING MEMBER, ENGAGING MEMER)

43a,44a: CLAW (HOOKING MEMBER CONSTITUTING ARRESTING MEANS)

43b,44b: CLAW (HOOKING MEMBER CONSTITUTING ARRESTING MEANS)

20: INK FOUNTAIN ROLLER
21: SIDE PLATE
30: INK TRAY
40: PRESSER (FIXING DEVICE)
41: FIXING SCREW (PRESSING MEANS)
42: LEVER (ROTATING MEMBER, ENGAGING MEMBER)
43a,44a: CLAW (HOOKING MEMBER CONSTITUTING ARRESTING MEANS)
43b,44b: CLAW (HOOKING MEMBER CONSTITUTING ARRESTING MEANS)
46: PIN (HOOKED MEMBER CONSTITUTING ARRESTING MEANS)
47: BRACKET (SUPPORTING MEMBER)

20: INK FOUNTAIN ROLLER
22: SIDE PLATE
30: INK TRAY
35: FIXING PIN
40: PRESSER (FIXING DEVICE)
41: FIXING SCREW (PRESSING MEANS)
42: LEVER (ROTATING MEMBER, ENGAGING MEMBER)
43a, 44a: CLAW (HOOKING MEMBER CONSTITUTING ARRESTING MEANS)
43b, 44b: CLAW (HOOKING MEMBER CONSTITUTING ARRESTING MEANS)
46: PIN (HOOKED MEMBER CONSTITUTING ARRESTING MEANS)
47: BRACKET (SUPPORTING MEMBER)

20 : INK FOUNTAIN ROLLER
22 : SIDE PLATE
30 : INK TRAY
35 : FIXING PIN
40 : PRESSER ( FIXING DEVICE )
41 : FIXING SCREW ( PRESSING MEANS )
42 : LEVER ( ROTATING MEMBER, ENGAGING MEMBER )
47 : BRACKET ( SUPPORTING MEMBER )
47a : ELONGATED HOLE

20: INK FOUNTAIN ROLLER
22: SIDE PLATE
23: INK FOUNTAIN
30: INK TRAY
35: FIXING PIN
40: PRESSER (FIXING DEVICE)
41: FIXING SCREW (PRESSING MEANS)
42: LEVER (ROTATING MEMBER, ENGAGING MEMBER)
47: BRACKET (SUPPORTING MEMBER)
47a: ELONGATED HOLE

20: INK FOUNTAIN ROLLER
22: SIDE PLATE
23: INK FOUNTAIN
30: INK TRAY
35: FIXING PIN
40: PRESSER (FIXING DEVICE)
41: FIXING SCREW (PRESSING MEANS)
42: LEVER (ROTATING MEMBER, ENGAGING MEMBER)
47: BRACKET (SUPPORTING MEMBER)
47a: ELONGATED HOLE

INK FOUNTAIN WITH TWO-POSITION TRAY

BACKGROUND OF THE INVENTION

1) Field of the Invention

The present invention relates to an ink supplying apparatus for use in a printing press such as a rotary press or a sheet-fed printing press, and more particularly to an ink supplying apparatus equipped with an ink tray attachable/detachable to an ink fountain.

2) Description of the Related Art

As FIGS. 12 and 13 show, a printing press such as a rotary press or a sheet-fed printing press is provided with an ink supplying apparatus 100 in which an ink fountain 102 is placed in front of an ink fountain roller 101. The ink fountain 102 is composed of a circumferential surface of the ink fountain roller 101, a plurality of ink keys (blades) 103 constituting a bottom section of the ink fountain 102, and two side plates 104 (only one on the interior side is shown in FIG. 12) provided at both side surfaces of each of the ink keys 103 so that their front edges come into contact with the circumferential surface of the ink fountain roller 101 to slide thereon. In this construction, an ink lying within the ink fountain 102 is supplied through a gap between the ink fountain roller 101 and the tip portion of each of the ink keys 103 to the ink fountain roller 101 and then transferred through a non-shown calling roller to a group of ink rollers lying on the downstream side.

The plurality of ink keys 103 are, as shown in FIG. 13, arranged in parallel with each other in a lateral direction of the apparatus so that the ink keys 103, 103 adjacent to each other are brought into sliding contact with each other while both the end ink keys 103 and the side plates 104 are brought into sliding contact with each other. In addition, the ink keys are made to be driven independently of each other to rock or swing about a supporting shaft 105, and an ink quantity control device 106 is situated under the respective ink keys 103.

The ink quantity control device 106 is provided with a adjusting cam 106*b* engaging with a lower surface of the tip portion of each of the ink keys 103 and a pusher 106*a* brought into contact with the adjusting cam 106*b* to rock the adjusting cam 106*b* by its telescopic motion, namely, protruding/retracting movements. Additionally, the tip portion of each of the ink keys 103 is driven to rock in a manner that the pusher 106*a* is operated appropriately to protrude/retract for rocking the adjusting cam 106*b* so that its engaging portion of the adjusting cam 106*b* with the ink key 103 lifts/lowers, thereby controlling the gap between the ink key 103 and the ink fountain roller 101 to adjust the thickness of the ink film to be supplied.

Meanwhile, in the aforesaid conventional ink supplying apparatus, a microscopic gap is secured between the adjacent ink keys 103, 103 and between both the end ink keys 103 and the side plates 104 in order to permit the mutual sliding motion. Accordingly, there is a possibility that the ink permeates through the very small gap, for example, between the ink keys 103, 103 by the capillary phenomenon or the like. If the ink is hardened after permeating through the gap between the ink keys 103, 103, the operation of the ink keys 103 becomes unstable and the worst case reaches the difficulty of movement thereof, so that a problem exists in that the high-accuracy control of the ink film becomes impossible.

In addition, after the completion of printing or in the ink replacement, although there is a need to clean the interior of the ink fountain 102 by wiping off the ink remaining in the interior of the ink fountain 102 with a waste or the like, or by washing it off with a cleaning solvent, the removal of the ink is difficult because the ink shows a high viscosity. Particularly, difficulty is experienced in removing the ink permeating into the gap between the ink keys 103, 103 so that a severe burden falls on the cleaning worker.

Still additionally, although, for improving the productivity, there is a need to shorten the preparation for the order change for enhancing the availability fact of the apparatus, if the load on the cleaning in the ink replacement is severe as mentioned above, the cleaning takes time largely. For this reason, it has been desired strongly to relieve the burden to be imposed on the worker through the labor-saving in the cleaning operation and further to enhance the availability factor of the apparatus through the shortening of the cleaning time.

Accordingly, this applicant has developed a construction in which an interior-placed container (which is referred to as an ink tray) for covering the upper surfaces of the ink keys or the inner surfaces of the side plates is detachably installed in the interior of the ink fountain for less direct adhesion of the ink to the ink keys or the side plates. In the case of the installation of such an ink tray, there exists one problem in a method for easy attachment/detachment of the ink tray.

SUMMARY OF THE INVENTION

It is therefore an object of the prevent invention to provide an ink supplying apparatus equipped with an ink tray capable of achieving the labor-saving of the cleaning operation and the shortening of the working time at ink replacement or the like in a printing press to improve the productivity, and designed to accomplish satisfactory attachment/detachment of the ink tray to improve the operational performance thereof.

For these purposes, an ink supplying apparatus according to this invention involves the following features.

First, for achieving the foregoing object, in accordance with this invention, an ink supplying apparatus which supplies an ink from an ink fountain to an ink fountain roller is characterized by comprising an ink tray set detachably in the interior of the ink fountain in a manner that brackets provided at its left- and right-hand end portions are mounted on side plates constituting left- and right-hand side walls of the ink fountain, a stopping section provided in the ink fountain to come into contact with a front end portion of the ink tray for stopping the ink tray, and a fixing device provided in front of the ink fountain for pressing each of the brackets against the stopping section to fix the ink tray in the ink fountain, wherein the fixing device includes a supporting member placed under a mounting plane of the bracket, a rotating member made to be rotatable in a plane substantially perpendicular to a cross direction of the apparatus in a state where its one end is supported by the supporting member, pressing means provided on the rotating member for pressing the brackets in a state where the rotating member rotates upwardly so that the ink tray is fixed in the ink fountain, and arresting means for arresting the rotation of the rotating member when the pressing means presses the brackets.

With this construction, when the ink tray is mounted in the ink fountain, the fixing device fixes the mounting position of the ink tray surely in the ink fountain to prevent the adhesion of the ink to the ink fountain certainly.

In addition, since the pressing means, coming into contact with the brackets to press it, is made to rotate together with the rotating member, at the removal/mounting of the ink tray from/into the ink fountain, the ink tray does not interfere with the pressing means and the rotating member so that the attachment/detachment of the ink tray from/to the ink fountain is facilitated to improve the operating efficiency.

Preferably, the arresting means is made up of a hooking member placed on the rotating member and a hooked member placed on an upward engaging locus of the rotating member, and the rotation of the rotating member is arrested in a manner that the hooking member catches the hooked member at the upward rotation of the rotating member.

In this case, since it is possible to arrest the rotation of the rotating member only by engaging the hooking member with the hooked member at the upward rotation of the rotating member, the fixing operation of the ink tray becomes easy.

More preferably, an elongated hole is made in the supporting member so that a supporting shaft set one end portion of the rotating member is supported rotatably by the elongated hole, and a claw is used as the hooking member while a pin is used as the hooked member so that the claw catches the pin in a manner that the rotating member is driven to slide along the elongated hole while being rotated upwardly on the supporting shaft.

In this case, since it is possible to arrest the rotation of the rotating member only by hooking the claw on to the pin, the operation becomes facilitated.

More preferably, a screw is used as the pressing means so that the bracket is pressed by the tip portion of the screw when the screw is tightened.

In this instance, since it is possible to press the bracket only by tightening the screw, the fixing of the ink tray becomes easy and, additionally, since the pressing force is adjustable by the degree of the tightening of the screw, the ink tray can be fixed surely at an optimal pressing force.

Furthermore, for achieving the object, in accordance with this invention, an ink supplying apparatus which supplies an ink from an ink fountain to an ink fountain roller is characterized by comprising an ink tray set detachably in the interior of the ink fountain and equipped with a pin protrusively formed on each of its left- and right-hand end portions, and a hooker installed on an operating space side in front of the ink fountain for catching the pin to temporarily hold the ink tray in the exterior of the ink fountain.

Thus, at the removal of the ink tray from the ink fountain, since the hooker is hooked on to the fixing pin to hold the ink tray temporarily, the operator can shift the ink tray from one hand to the other for easy carrying, thus lessening the burden to be imposed on the operator who handles the ink tray.

In addition, since the ink tray can temporarily be held immediately after the removal from the ink fountain, the operator can conduct various operations, such as cleaning of the interior of the ink fountain and cleaning of the ink tray itself, while handling the ink tray, thus accomplishing the operations according to a higher-efficiency program.

Preferably, on the front side of the ink fountain, a fixing device is provided which comprises a engaging member engaging/disengaging with/from the pin and engages said engaging member with said pin to fix said ink tray in the interior of said ink fountain, and said engaging member functions as said hooker when said engaging member is disengaged from said pin.

In this case, since the engaging member constituting the fixing device for fixing the ink tray is also used as the hooker, the number of parts is reducible.

More preferably, the ink tray is set in the interior of the ink fountain in a manner that brackets set on its left- and right-hand end portions are mounted on side plates constituting left- and right-hand side walls of the ink fountain, and a supporting member is placed under a mounting plane of the brackets, while the engaging member is rotated in a plane substantially perpendicular to a cross direction of the apparatus in a state where one end portion of the engaging member is supported by the supporting member and engages with the pin in a state rotated upwardly and functions as the hooker in a state rotated downwardly.

In this instance, since the engaging member functions as the hooker when rotated to under the bracket mounting plane, if the ink tray is drawn out from the ink fountain to the front side and shifted dowanwardly, the fixing pin is caught by the hooker to hold the ink tray temporarily, which permits easy handling of the ink tray without imposing a burden.

DESCRIPTION OF THE PREFERRED EMBODIMENTS

An embodiment of the present invention will be described hereinbelow with reference to the drawings.

Figure 1:
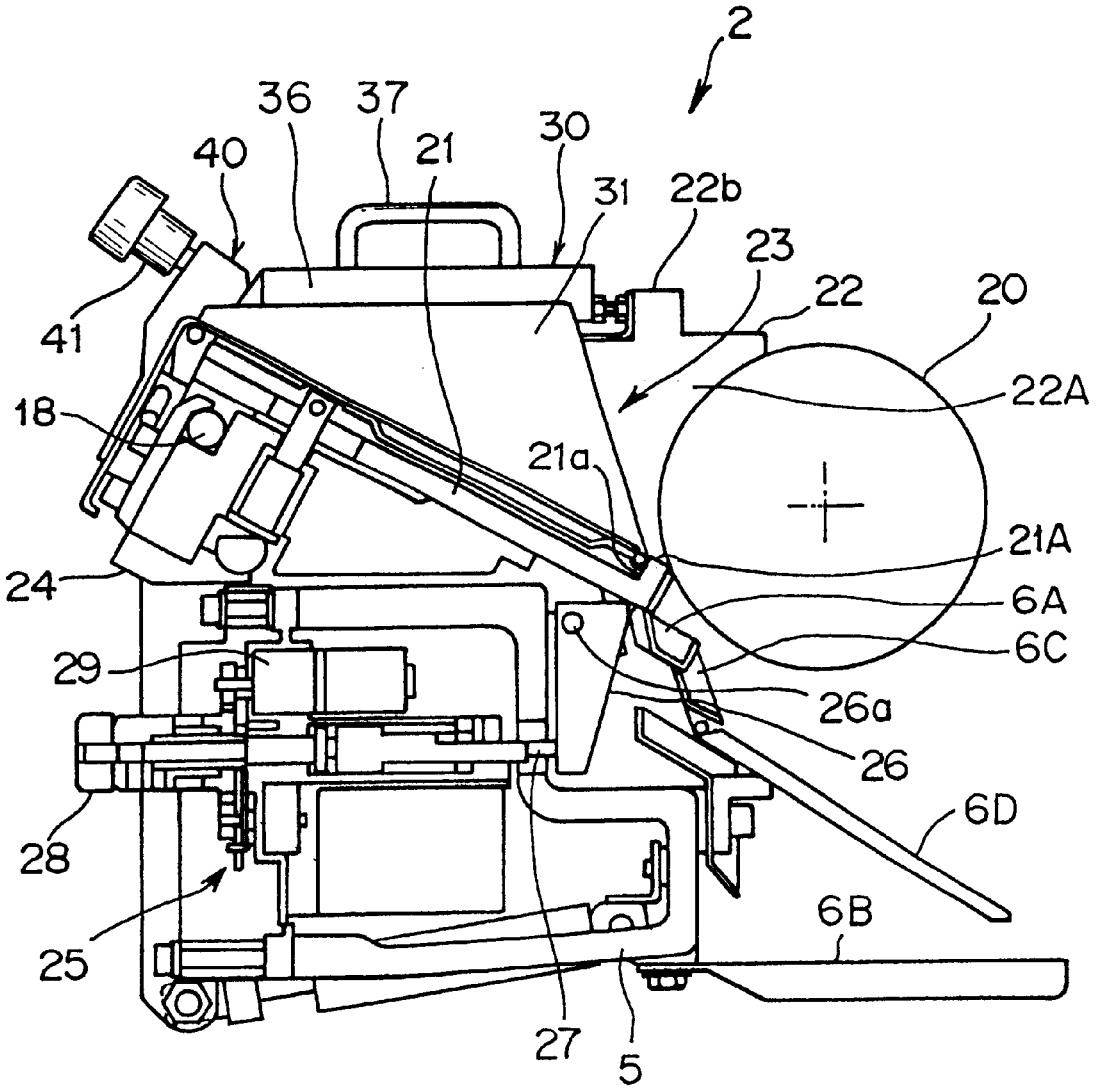
FIG. 1 is a side elevational view schematically showing a construction of an ink supplying apparatus according to an embodiment of the present invention.

The description starts at the outline of a construction of an ink supplying apparatus according to this embodiment. As FIG. 1 shows, the ink supplying apparatus, designated generally at reference numeral 2, is equipped with an ink fountain 23 defined by a circumferential surface of an ink fountain roller 20, ink keys 21 and side plates 22 so that an ink is put in the ink fountain 23 and supplied to the ink fountain roller 20 in printing. A plurality of ink keys 21 are arranged in a cross (transverse) direction of the apparatus in a state of coming closely into contact with each other, and their rear end portions are supported rotatably by a supporting shaft 18 set on a supporting base 24. The side plates 22 are fixedly secured onto the supporting base 24 in a state where the ink keys 21 are interposed therebetween, and their front end portions are brought into sliding contact with the circumferential surface of the ink fountain roller 20.

In addition, under the ink fountain 23, a horizontal beam 5 is installed to support components constituting the ink fountain 23, and an ink quantity control device 25 is set on this horizontal beam 5. The ink quantity control device 25 is made up of an adjusting cam 26 engaging with a lower surface of the tip portion of each of the ink keys 21, and a pusher 27 made to be brought into contact with the adjusting cam 26 at its tip portion and, further, to be protruded and retracted (extensible/contractible) in the longitudinal (forward and backward) directions in accordance with the rotations of a knob 28 or a motor 29. Accordingly, if the pusher 27 is protruded or retracted suitably to lift or lower the adjusting cam 26 in a state where the adjusting cam 26 rocks or swings around a supporting point 26*a*, then the tip portion of each of the ink keys 21 is driven to rock, thereby controlling the gap between the ink key 21 and the ink fountain roller 20 to adjust the thickness of an ink film to be supplied thereinto. Add to it that, under the tip portions of the ink keys 21, a first ink receiver 6A is placed to receive the ink dropping from the ink keys 21 and guides 6C, 6D are situated to guide the ink from the interior of the first ink receiver 6A to a second ink receiver 6B.

Figure 2:
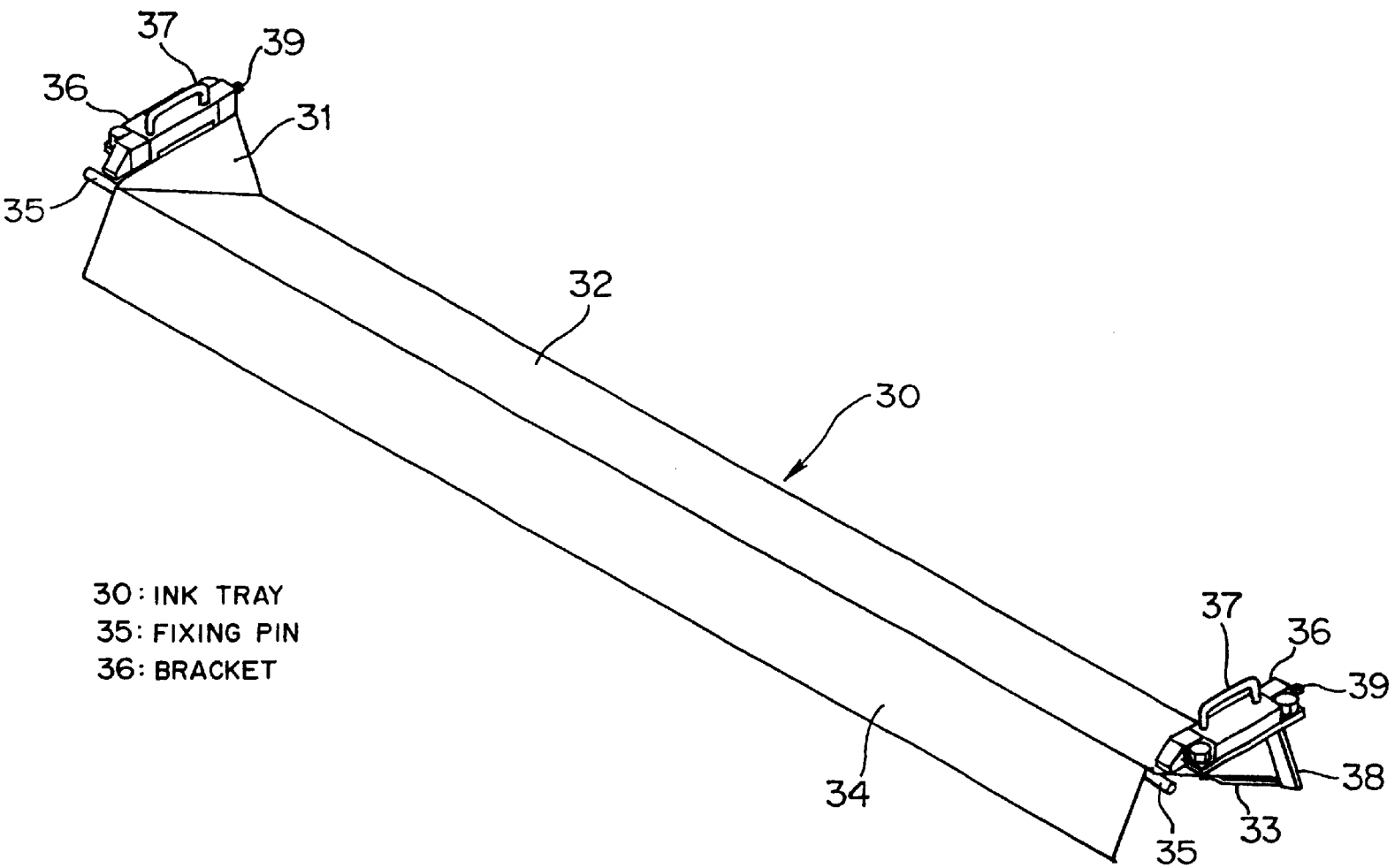
FIG. 2 is a perspective view showing a construction of an ink tray of the ink supplying apparatus according to the embodiment of this invention.
Figure 3:
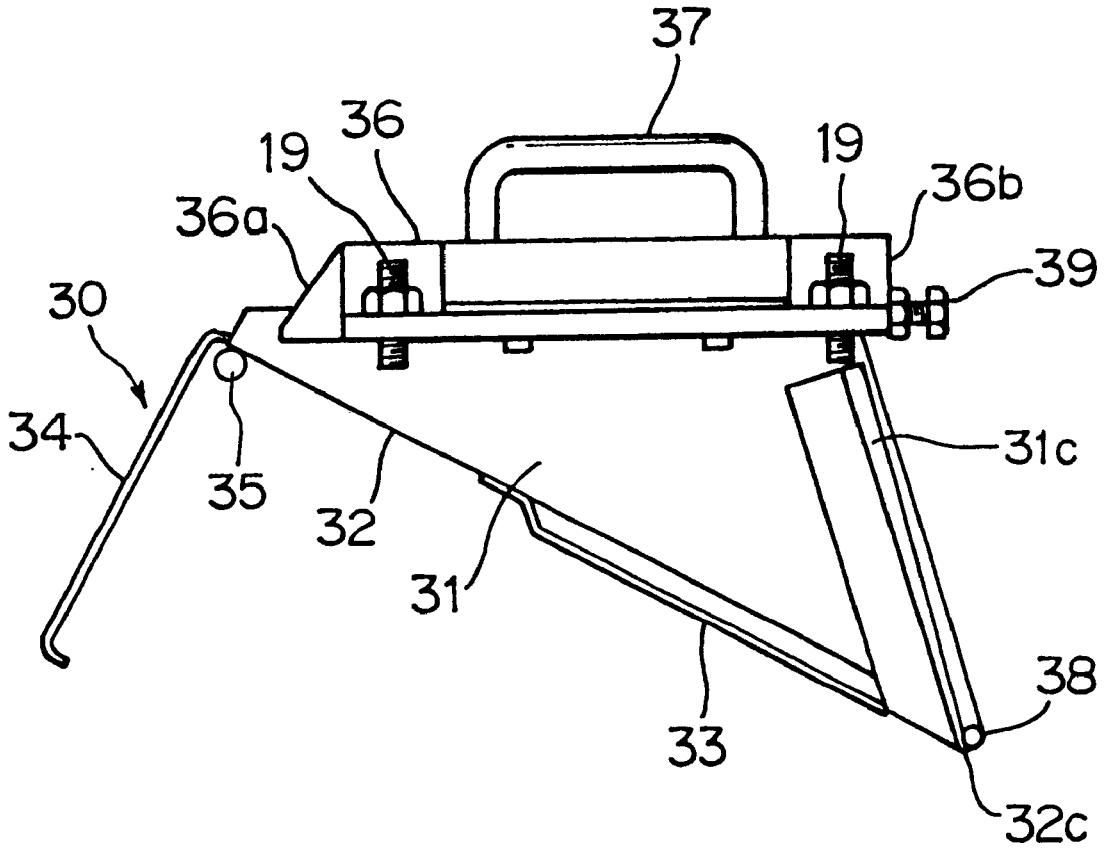
FIG. 3 is a side elevational view showing a construction of the ink tray of the ink supplying apparatus according to the embodiment of this invention.
Figure 4:
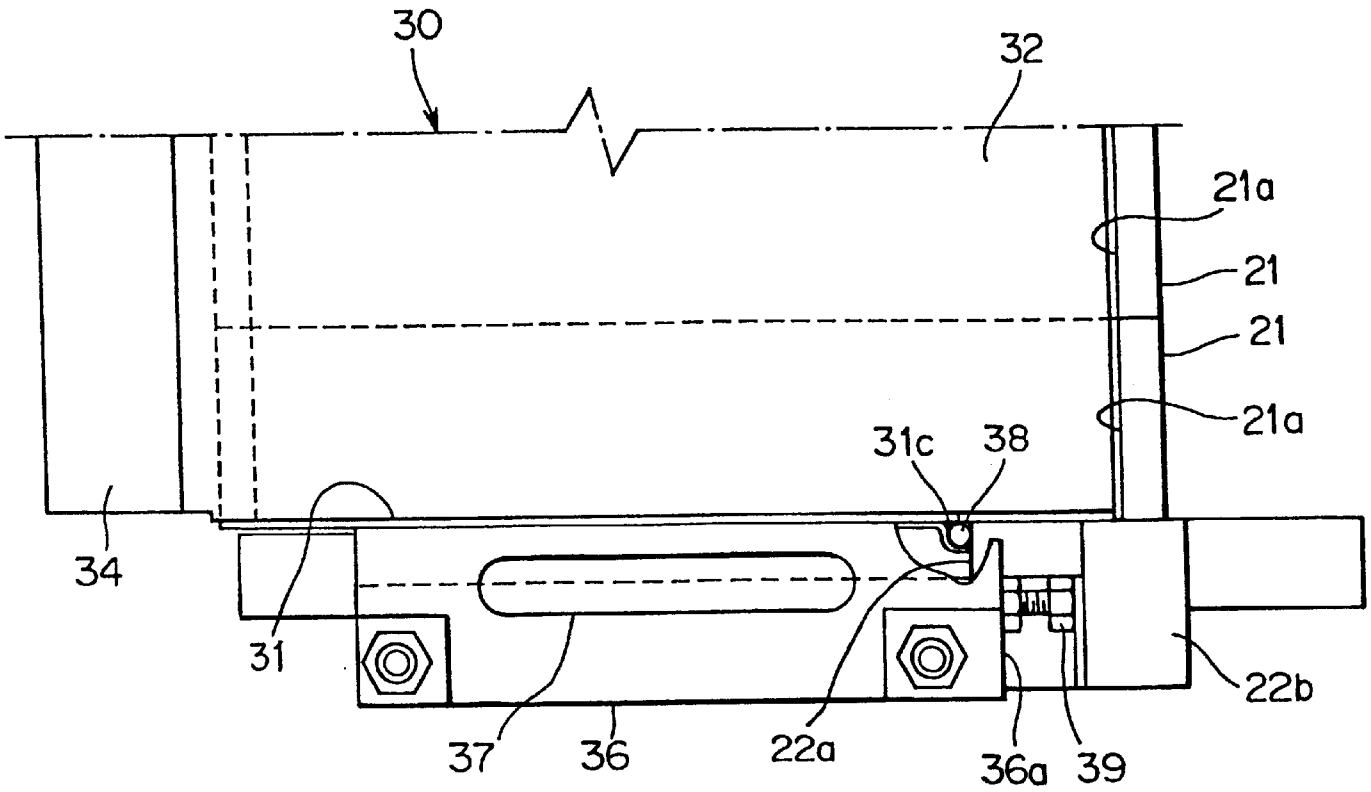
FIG. 4 is an illustration of a state of engagement between the ink tray and an ink fountain in the ink supplying apparatus according to the embodiment of this invention, where a bracket is partially broken away.

Still additionally, this ink supplying apparatus 2 is provided with an ink tray 30 placed detachably in the interior of the ink fountain 23. As FIGS. 2 to 4 show, the ink tray 30 is made up of side walls 31, 31 formed in corresponding relation to the left- and right-hand side plates 22, 22 of the ink fountain 23, and a bottom plate 32 set in a state where its tip side is tilted downwardly to the ink keys 21 constituting a bottom section of the ink fountain 23.

The lower surface of the bottom plate is reinforced by a reinforcing plate 33, and the rear end portion of the bottom plate 32 is extended outwardly and downwardly to form a cover 34 for preventing the adhesion of the ink to the supporting base 24. Additionally, left- and right-hand pins 35, 35 are protrusively formed in the cross directions from a boundary section between the bottom plate 32 and the cover 34. Still additionally, brackets 36, 36 are fixedly secured onto the upper end portions of the side walls 31, 31 of the ink tray 30, respectively, in a state directed outwardly. Moreover, a handle 37 is set on an upper surface of each of the brackets 36.

This ink tray 30 covers most of the ink keys 21 and the side plates 22 (these sections will be referred to hereinafter as coated sections) so that they do not come directly into contact with the ink within the ink fountain 23, whereas the upper surface of the tip portion of each of the ink keys 21 and the inner surface of the tip portion of each of the side plates 22, which slide on the ink fountain roller 20 in a state where an ink liquid film is interposed therebetween, are exposed so as to come directly into contact with the ink within the ink fountain 23 without being covered with the ink tray 30 (these sections will be referred to hereinafter as an exposed section). That is, the inner circumferetial surface of the ink fountain 23 is formed by an inner surface of the ink tray 30, an upper surface of the exposed section (the tip portion) 21A of each of the ink keys 21, an exposed section 22A of each of the side plates 22 and an outer circumferential surface of the ink fountain roller 20.

The portion between the ink tray 30 and the tip portion (exposed section) 21A of each of the ink keys 21 or the portion between the ink tray 30 and the exposed section 22A of each of the side plates 22 constitutes a joint of the ink fountain 23, and these portions require sealing processing. For this reason, holders 31*c* and 32*c* are set in outer surfaces of the tip portions of the side walls 31, 31 and the bottom plate 32, respectively, with a packing (sealing member) 38 having a continuous sealing surface being fitted in the holders 31*c* and 32*c*.

In a state where the ink tray 30 is mounted in the ink fountain 23, of the packing 38, portions fitted in the holder 31*c* made in the outer surfaces of the tip portions of the side walls 31 are brought under pressure into contact with vertical wall portions of steps (stopping section) 22*a* formed on inner surfaces of the side plates 22 of the ink fountain 23, and of the packing 38, a portion fitted in the recess groove 32*c* made in the outer surface of the tip portion of the bottom plate 32 is brought under pressure into contact with a vertical wall portion (see FIG. 1) of a step (stopping section) 21*a* formed on an upper surface of the tip portion of each of the ink keys 21.

In addition, this packing 38 seals the portions between the tip portions of the side walls 31, 31 of the ink tray 30 and the side plates 22, 22 of the ink fountain 23 and the portions between the tip portion of the bottom plate 32 of the ink tray 30 and the upper surfaces of the ink keys 21 of the ink fountain 23 so that the ink leakage from the ink fountain 23 is preventable at the joints between the ink tray 30 and the ink keys 21 and between the ink tray 30 and the side plates 22.

As described above, since the ink tray 30 is detachably set in the interior of the ink fountain 23, the contact area of the ink keys 21 with the ink is considerably reducible to lower the possibility that the ink permeates into the gap between the ink keys 21, 21, which not only stabilizes the operations of the ink keys 21 but also shortens the cleaning time of the interior of the ink fountain 23, thus improving the availability factor of the apparatus and the productivity. Incidentally, the ink tray 30 shown in FIGS. 5A, 5B and 7 to 11 is different in shapes of the brackets 36 and the handles 37 from that shown in FIGS. 1 to 4. However, these illustrations are for showing another possible construction of this ink tray 30, and the function thereof is substantially the same.

Meanwhile, although the packing 38 is used for sealing the gap between the ink tray 30 and the ink keys 21 and the gap between the ink tray 30 and the side plates 22, in order to accomplishing the sealing surely for the prevention of the ink leakage, there is a need to fix the ink tray 30 in the ink fountain certainly and accurately. Additionally, in order to improve the operational efficiency at the ink replacement and to improve the productivity, there is a need to facilitate the attachment/detachment of the ink tray 30. For these purposes, a need for a construction which does not cause the hindrance at the attachment/detachment of the ink tray 30 exists on the fixing means of the ink tray 30.

Because of the existence of this necessity, in this ink supplying apparatus 2, the fixing of the ink tray 30 in the ink fountain 23 is made by a presser (fixing device) 40 having the following construction.

Figure 5B:
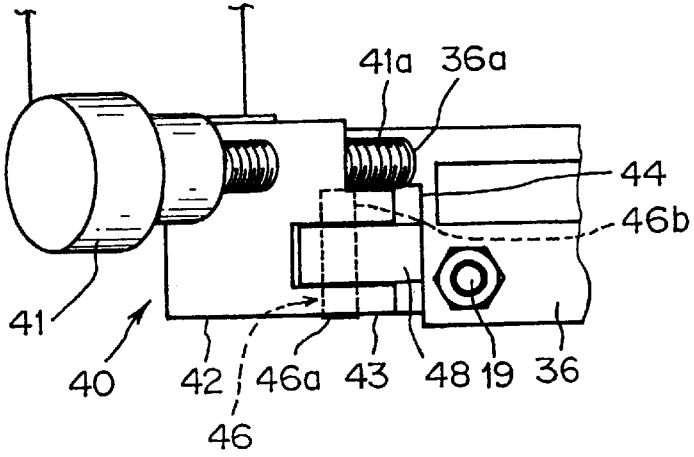
FIG. 5B is a side elevational view showing the construction of the presser in the ink supplying apparatus according to the embodiment of this invention.
Figure 5A:
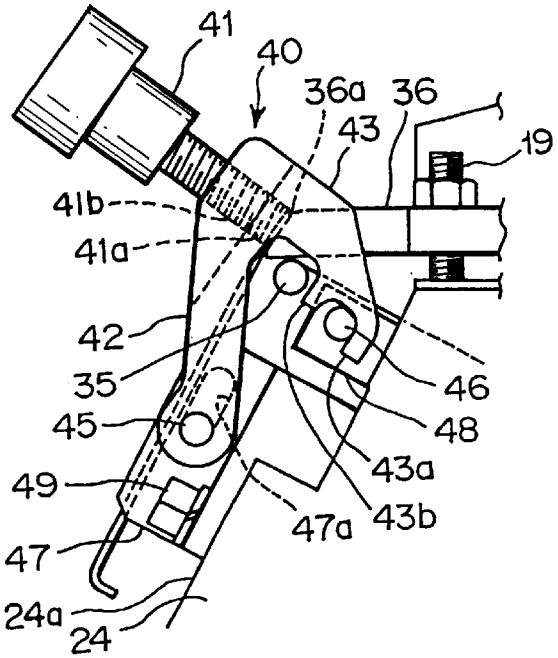
FIG. 5A is a side elevational view showing a construction of a presser in the ink supplying apparatus according to the embodiment of this invention.
Figure 6:
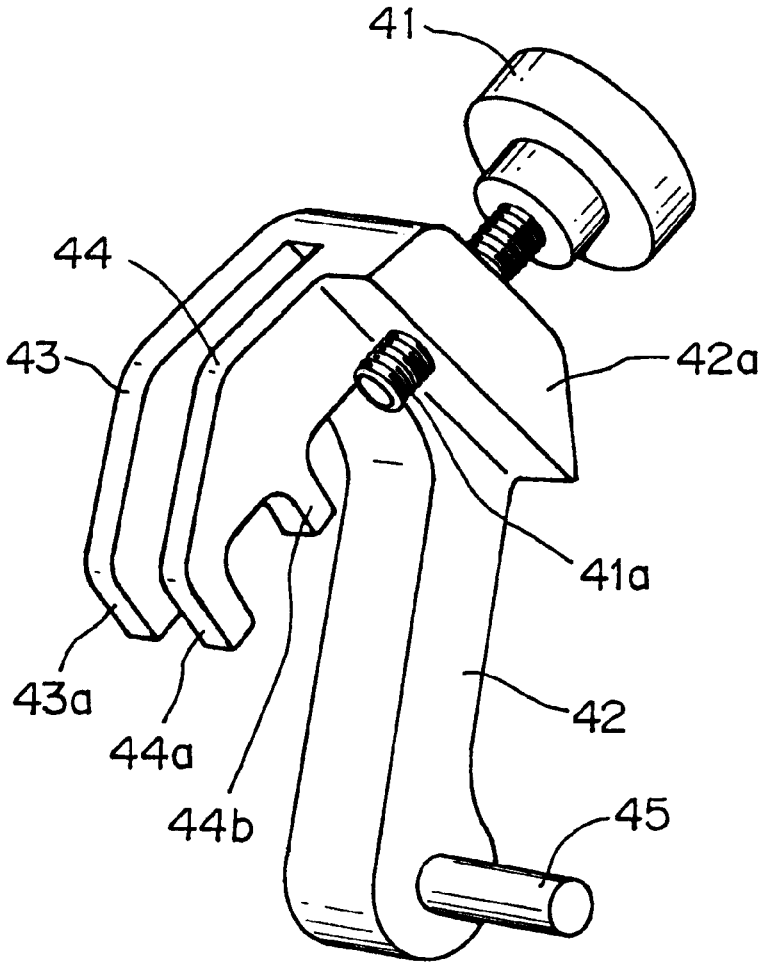
FIG. 6 is a perspective view showing a construction of a lever in the ink supplying apparatus according to the embodiment of this invention.

The presser 40 is a device for fixing the ink tray 30 by pressing an inclined surface 36*a* of a rear portion of each of the brackets 36 of the ink tray 30, and is provided at each of both left- and right-hand end portions of the supporting base 24 in connection with each of the left- and right-hand brackets 36, 36. A description of a concrete construction of the presser 40 is as follows. That is, as FIGS. 5A to 6 show, the presser 40 is mainly made up of a lever (rotating member, engaging mamber) 42 equipped with a fixing screw (pressing means) 41, a bracket (supporting member) 47 or bearing the lever 42 and a pin (hooked member) 46 for fixing the lever 42. In these illustrations, the presser 40 is one standing on the right-hand side when viewed from the operator side.

The bracket 47 is fixedly secured through a bolt 49 or the like to a back (surface directed to the operator) 24*a* of the supporting base 24, and an elongated hole (slit) 47*a* having an elliptic configuration in cross section is made to penetrate the bracket 47 in a cross direction of the apparatus. The position and direction of the elongated hole 47*a* are set so that the rear portion inclined surface 36*a* of the bracket 36 of the ink tray 30 lies on the lengthwise prolongation of the ellipse of the elongated hole 47*a*.

Furthermore, the bolt 49 is disposed under the elongated hole 47*a* and outside it in the cross-direction of the apparatus, and is positioned on a rotating locus of the lever 42, which will be described later, to function as a stopper for the lever 42.

The pin 46 is provided in a state where its central portion is supported by a bracket 48 fixedly secured to the back 24*a* of the supporting base 24 while both end portions 46*a* and 46*b* protrude in the cross directions of the apparatus. The bracket 48 is positioned above the above-mentioned bracket 47 and outside it in the cross direction of the apparatus to be interposed between the loci of arms 43 and 44 of the lever 42 which will be described later. In addition, the length of the pin 46 is set so that its inside portion (on the end portion 46*b* side) has a length which does not cause the interference with the ink tray 30 while its outside portion has a length substantially equal to that of the pin 35 of the ink tray 30.

Secondly, a description will be given hereinbelow of a construction of the lever 42. The lever 42 is, at its one end portion, equipped with a pin 45, and is, at the other end portion, provided with two arms 43 and 44 parallel with each other. The pin 45 is disposed to be perpendicular to the lever 42, while the arms 43 and 44 are disposed to be parallel with the rotating plane of the lever 42 on the pin 45. The arms 43 and 44 have a configuration curved inwardly, and the tip portions and intermediate portions of the inner side thereof have claws (hooking members) 43*a*, 44*a*, 43*b* and 44*b*, respectively, constituting arresting means. The separation or interval between the arms 43 and 44 is set to be somewhat larger than the width of the bracket 48 so that the bracket 48 is put between the arms 43 and 44 when the ink tray 30 is in a fixed condition.

In addition, at the junction between the arm 44 on the disposition side of the pin 45 and the lever 42, a bracket 42*a* is installed to support the fixing screw 41. A screw hole 41*b* is made in the bracket 42*a*, and the fixing screw 41 is engaged with the screw hole 41*b* in a state where its tip portion (screw section) 41*a* is directed inwardly (the extending side of the arms 43 and 44).

Moreover, a description will be given hereinbelow of the relationship in engagement among the respective components (the lever 42, the bracket 47, the pin 46 and others) of the presser 40. First, a description will be made of the engaging relationship between the lever 42 and the bracket 47. The lever 42 is disposed outside the bracket 47 in the cross direction of the apparatus, and the pin 45 placed at its end portion is inserted into the elongated hole 47*a*. The pin 45 is supported rotatably in the interior of the elongated hole 47*a* so that the lever 42 is rotatable on the pin 45 and movable in parallel with the elongated hole 47*a*.

When the lever 42 is rotated, the bolt 49 and the bracket 48 exist in its rotating locus thereof as mentioned above. First, when the lever 42 is downwardly rotated counterclockwise, a back 42*b* of the lever 42 comes into contact with the bolt 49 to inhibit further rotation thereof. That is, the bolt 49 functions as a stopper for stopping the rotation of the lever 42. At this time, the lever 42 is tilted downwardly in a state where the arms 43 and 43 are directed upwardly, and also functions as a hook engaging with the pin 35 of the ink tray 30 (see FIGS. 9 to 11).

Figure 8:
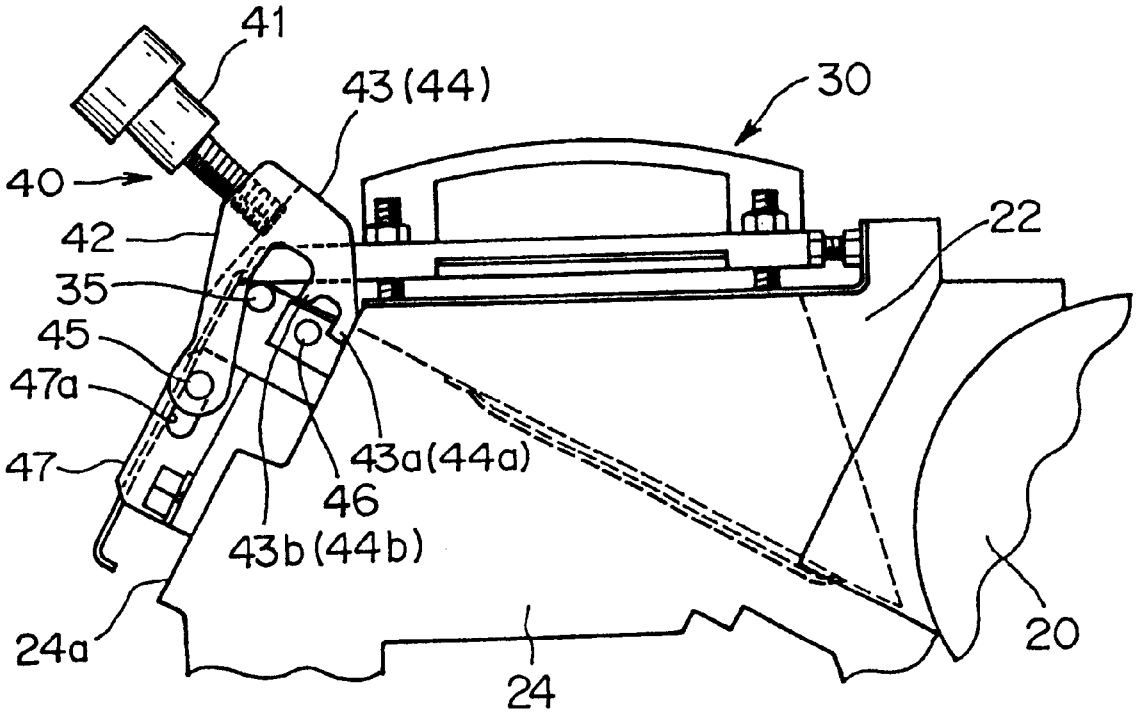
FIG. 8 is a side elevational view useful for describing the attachment/detachment of an ink tray in the ink supplying apparatus according to the embodiment of this invention.
Figure 9:
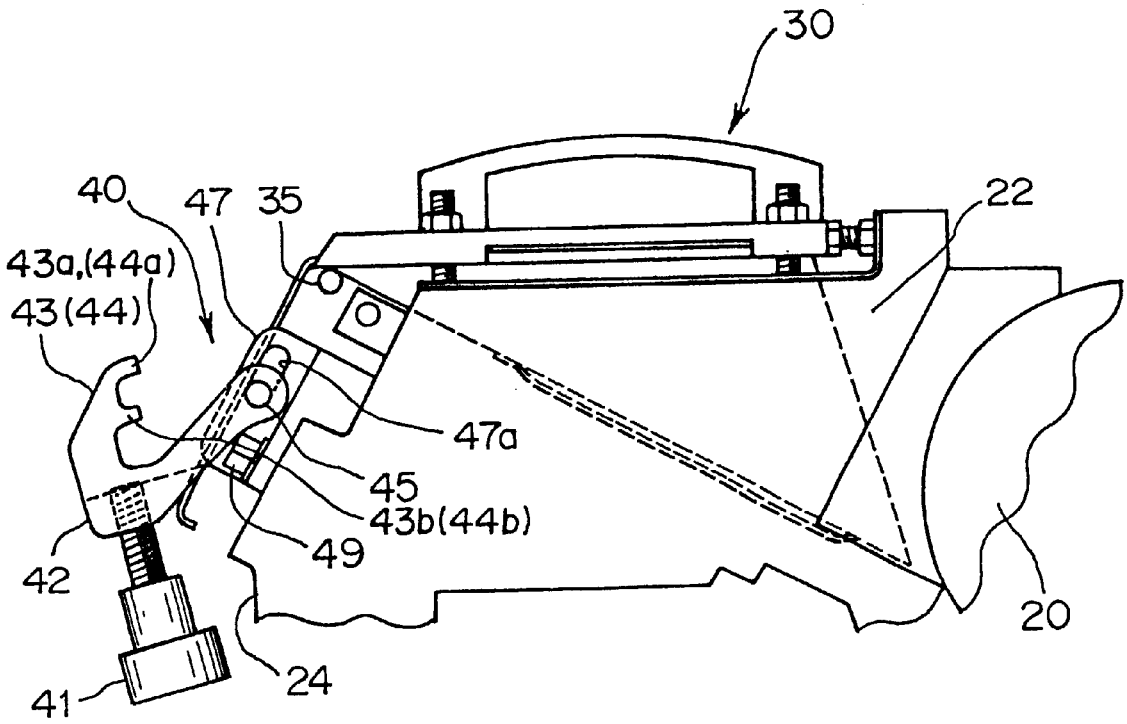
FIG. 9 is a side elevational view useful for describing the attachment/detachment of an ink tray in the ink supplying apparatus according to the embodiment of this invention.

On the other hand, when the lever 42 is upwardly rotated clockwise from the state shown in FIG. 9, although the arms 43 and 44 may interfere with the pins 35 and 46 in this state, since the lever 42 is engaged with the pin 45 forming the rotary shaft of the lever 42 by means of the elongated hole 47*a*, as shown in FIG. 8, the interference therewith is avoidable in a manner that the lever 42 is operated so that the pin 45 slides upwardly with respect to the elongated hole 47*a*. That is, the distance between the claws 43*a* and 44*a* at the tip portions of the arms 43, 44 and the pin 45 is set to be longer than, at least the distance between the pin 35 or 46 and the upper end of the elongated hole 47*a*.

In contrast with this, the distance between the claws 43*a*, 44*a* and the pin 45 is set to be substantially equal to or shorter than the distance between the pin 46 and the lower end of the elongated hole 47*a*. Additionally, the bracket 48 is positioned between the rotating loci of the arms 43 and 44 as stated above. Accordingly, if the pin 45 is operated upwardly to slide along the elongated hole 47*a* to avoid the interference between the claws 43*a*, 44*a* and the pins 35, 46 and, subsequently, the pin 45 is again shifted downwardly along the elongated hole 47*a*, as shown in FIGS. 5A and 5B, the end portions 46*a* and 46*b* of the pin 46 are loosely fitted in the groove between the claws 43*a*, 43*b* and in the groove between the claws 44*a*, 44*b*, respectively. At this time, the pin 35 is accommodated in the curved portion between the claws 43*b*, 44*b* and the lever 42.

As described above, when the claws 43*a*, 43*b* of the arm 43 and the claws 44*a*, 44*b* of the arm 44 are engaged with the pin 46, as shown in FIGS. 5A and 5B, the rear portion inclined surface 36*a* of the bracket 36 of the ink tray 30 is positioned on the axis of the fixing screw 41. Furthermore, when the fixing screw 41 is tightened, the tip portion 41*a* thereof comes into contact with the rear portion inclined surface 36*a*, and if further tightened, the claws 43*a* and 44*a* are hooked to the pin 46; therefore, the rotation of the lever 42 is arrested, and still further tightened, the tip portion 41*a* of the fixing screw 41 pushes the rear portion inclined surface 36*a*. The screw hole 41*b* engaging with the fixing screw 41 is made so that the fixing screw 41 and the rear portion inclined surface 36*a* meet each other at right angles.

In this ink supplying apparatus 2, with the above-described construction of the presser 40, by tightening the fixing screws 41, 41 for the left- and right-hand pressers 40, 40, the rear portion inclined surfaces 36*a*, 36*a* of the left- and right-hand brackets 36, 36 are pressed toward the tip portion of the ink tray 30 (toward the gap between the ink keys 21 and the ink fountain roller 20) so that the sealing member 38 of the ink tray 38 is pressed against the steps 22*a*, 21*a* of the ink fountain 23, thus fixing the ink tray 30.

Furthermore, the front end portions 36*b* of the left- and right-hand brackets 36 are equipped with positioning bolts 39 for positioning the ink tray 30, respectively. The mounting position of the ink tray 30 in the longitudinal directions is defined with the positioning bolts 39 being brought into contact with projecting portions 22*b* formed on the upper surface of the side plates 22. Incidentally, the position of the ink tray 30 in the longitudinal directions is adjustable by controlling the tightening quantity of the positioning bolts 39, while the position thereof in the vertical (height) directions is adjustable by height adjusting screws 19 set in the brackets 36.

Since the ink supplying apparatus 2 according to the embodiment of this invention is thus constructed, the attachment/detachment of the ink tray 30 to/from the ink fountain 23 are made as follows.

Figure 7:
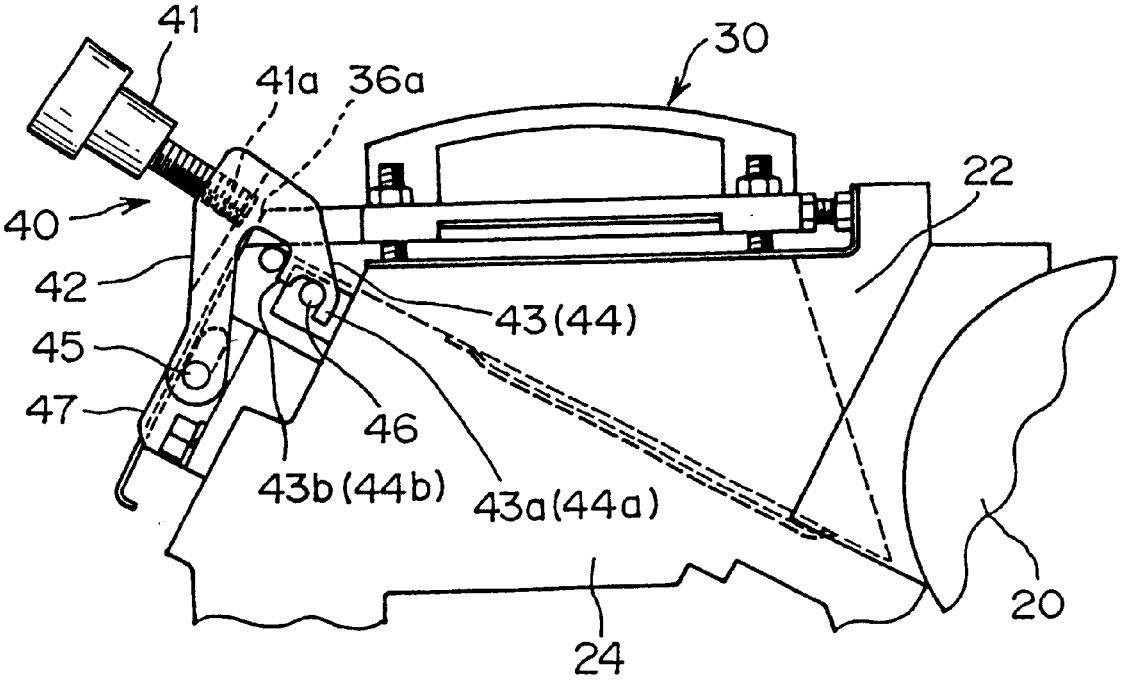
FIG. 7 is a side elevational view useful for describing attachment/detachment of an ink tray in the ink supplying apparatus according to the embodiment of this invention.

First, when the ink tray 30 is detached from the ink fountain 23, as shown in FIG. 7, each of the fixing screws 41 is loosened so that its tip portion 41*a* is separated from the rear portion inclined surface 36*a* of the bracket 36 to some extent. Additionally, as shown in FIG. 8, the lever 42 is pulled upwardly in a state where the fixing screw 41 is held by hand. At this time, the lever 42 slides upwardly according to the length of the elongated hole 47*a* to release the pin 46 and the claws 43*a*, 43*b* and 44*a*, 44*b* of the arms 43 and 44 from the engagement therebetween.

After the pin 46 is released from the engagement, as shown in FIG. 9, the lever 42 is shifted downwardly along the elongated hole 47*a* while being rotated downwardly (counterclockwise in FIG. 9) on the pin 45. The rotation of the lever 42 is stopped when its back is brought into contact with the bolt 49 and the pin 45 is lowered up to the lower end of the elongated hole 47*a*, and the lever 42 is maintained in this positional state by the self-weight, that is, kept in the downwardly tilted condition in a state where the arms 43 and 44 turn upwardly.

Figure 10:
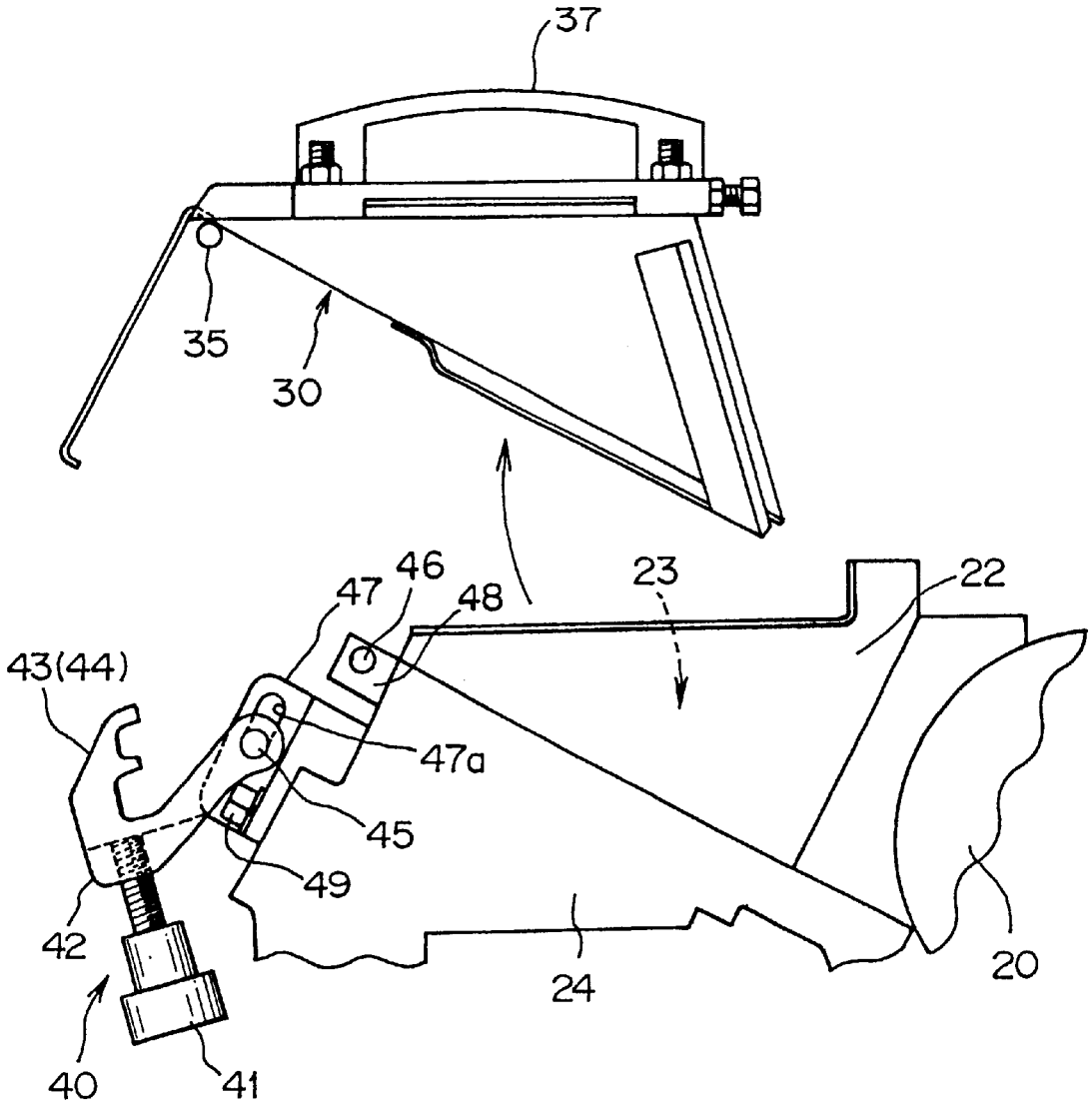
FIG. 10 is a side elevational view useful for describing the attachment/detachment of an ink tray in the ink supplying apparatus according to the embodiment of this invention.

When the left- and right-hand pressers 40 are operated as described above, the ink tray 30 is released from the fixing to the ink fountain 23. Additionally, as shown in FIG. 10, the left- and right-hand handles 37 are held by hands and the ink tray 30 is drawn out from the ink fountain 23. At this time, since the lever 42 is rotated downwardly as mentioned above so that there is no hindrance in the direction of drawing out the ink tray 30, the ink tray 30 can easily be drawn out therefrom.

Figure 11:
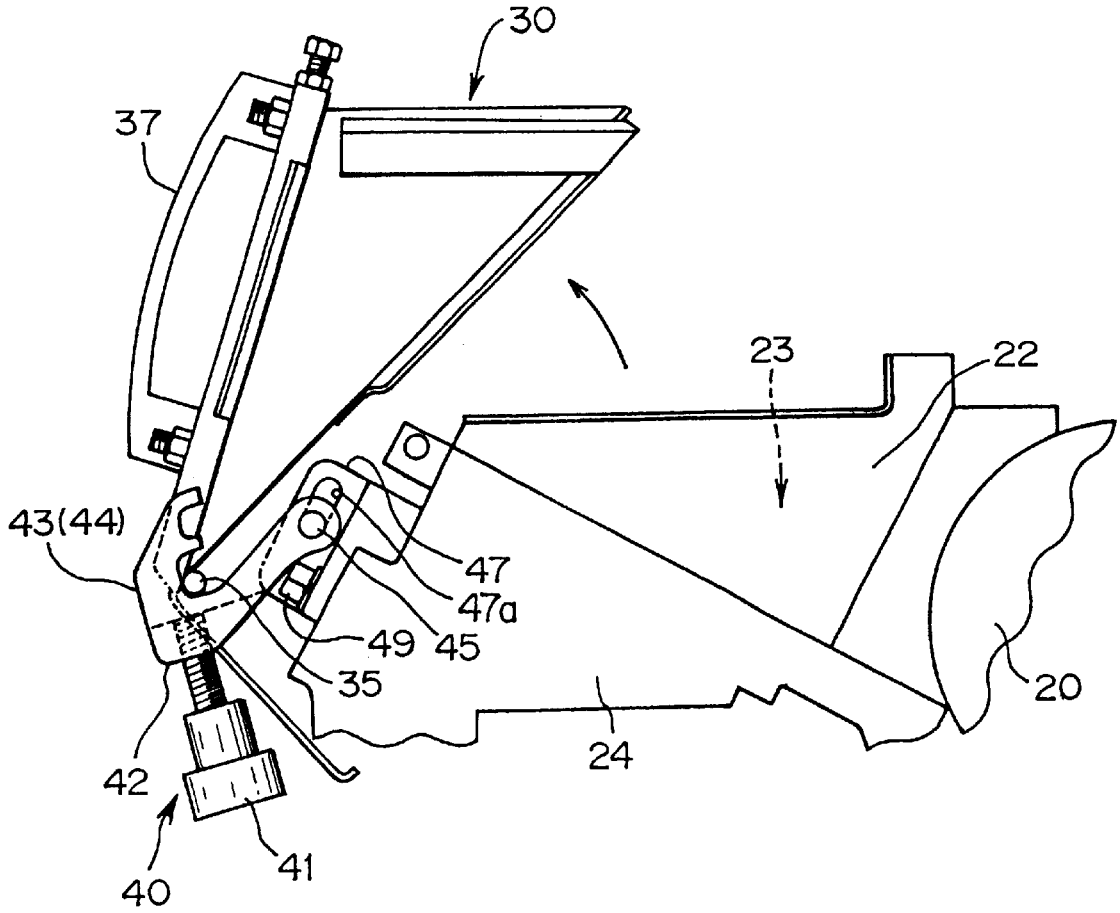
FIG. 11 is a side elevational view useful for describing the attachment/detachment of an ink tray in the ink supplying apparatus according to the embodiment of this invention.
Figure 12:
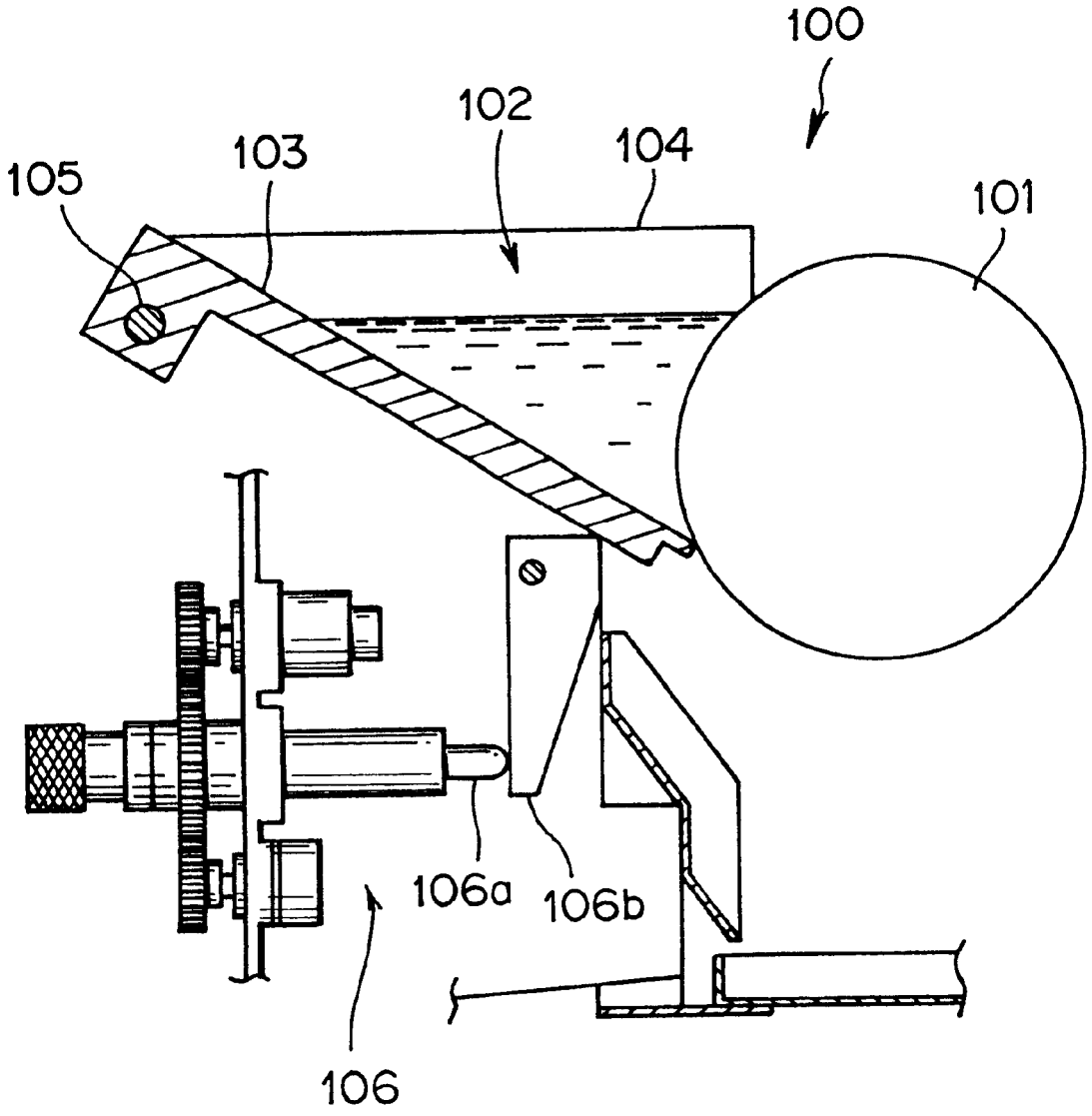
FIG. 12 RELATED ART
FIG. 12 is a side elevational view illustratively showing a construction of a conventional ink supplying apparatus.
Figure 13:
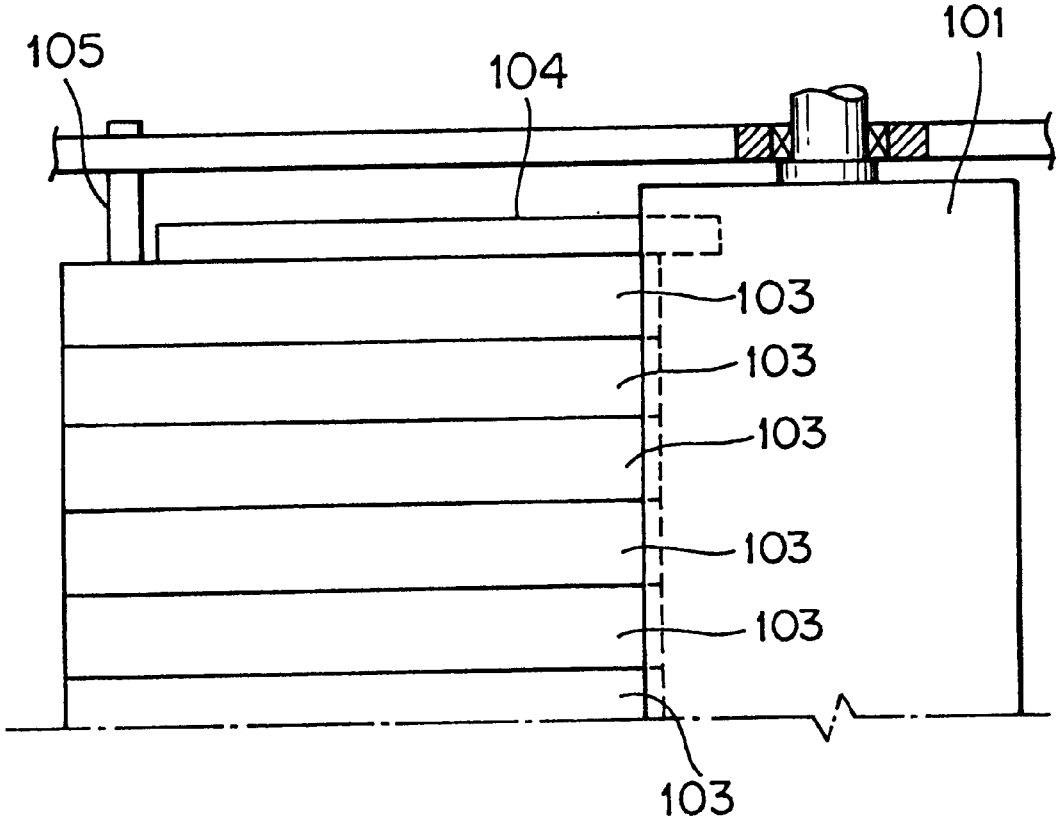
FIG. 13 RELATED ART
FIG. 13 is a top view illustratively showing the interior of an ink fountain in a construction of the conventional ink supplying apparatus.

Moreover, since the lever 42 is maintained in the downwardly tilted condition in a state where the arms 43 and 44 turn upwardly, the lever 42 can also be used as a hook to be hooked to the pin 35. That is, after the ink tray 30 is drawn out from the ink fountain 23 in a state where the left- and right-hand handles 37 are held by hands, as shown in FIG. 11, if the levers 42, 42 are hooked on to the left- and right-hand pins 35, 35, then the ink tray 30 drawn out from the ink fountain 23 is maintainable temporarily. Accordingly, the operator can shift the ink tray 30 from one hand to the other for easy carrying, or can clean the interior of the ink fountain 23 in a state where the ink tray 30 is in the temporarily held condition.

In the case in which the ink tray 30 is mounted in the ink fountain 23, the operation reverse to the above-described operation is conducted. That is, the handles 37 are held by hands to carry the ink tray 30 as shown in FIG. 10, and the left- and right-hand brackets 36, 36 are hooked on to the side plates 22, 22 to place the ink tray 30 in the interior of the ink fountain 23 as shown in FIG. 9. At this time, the ink tray 30 is not placed directly in the ink fountain 23, but it can be set in the ink fountain 23 after being temporarily held with the levers 42, 42 being hooked on to the left- and right-hand pins 35, 35.

After the ink tray 30 is set in the ink fountain 23, the positioning bolts 39 are brought into contact with the projecting portions 22*b* on the upper surfaces of the side plates 22 so that the ink tray 30 is positioned in the longitudinal directions. Additionally, if needed, the adjustment of the position thereof in the forward/backward or vertical directions is made by controlling the tightening quantity of the positioning bolts 39 or the height adjusting screws 19.

After the completion of the positioning of the ink tray 30, as shown in FIG. 8, each of the levers 42 is rotated upwardly while the pin 45 is driven to slide up to the upper end of the elongated hole 47*a*. When the lever 42 rotated is brought into contact with the pin 35, the lever 42 is pressed downwardly so that the pin 46 engages with the claws 43*a*, 43*b*, 44*a* and 44*b* of the arms 43 and 44 as shown in FIG. 7. Additionally, on the engagement between the pin 46 and the claws 43*a*, 43*b*, 44*a* and 44*b*, the fixing screw 41 is tightened to cause the tip portion 41*a* of the fixing screw 41 to push the rear portion inclined surface 36*a* so that the sealing member 38 of the ink tray 30 is pressed against the step portions 22*a* and 21*a* of the ink fountain 23 for the fixing the ink tray 30.

As described above, according to this ink supplying apparatus 2, when the ink tray 30 is mounted in the ink fountain 23, the presser 40 presses the sealing member 38 of the ink tray 30 against the step portions 22*a* and 21*a* of the ink fountain 23 for fixing the ink tray 30 in the ink fountain 23; therefore, it is possible to surely seal the gaps between the ink tray 30 and the ink keys 21 and between the ink tray 30 and the side plates 22 for prevention of the ink leakage. Add to it that the pressing force is adjustable properly by the tightening degree of the fixing screw 41.

In addition, the completion of the fixing of the ink tray 30 by the presser 40 depends only upon that the claws 43*a*, 43*b*, 44*a* and 44*b* at the tip portions of the arms 43 and 44 extending from the lever 42 catch the pin 46 and the fixing screw 41 is tightened afterwards, and the release of the ink tray 30 from the fixing to the ink fountain 23 relies only upon the loosening of the fixing screw 41 and the release of the claws 43*a*, 43*b*, 44*a* and 44*b* from the engagement with the pin 46; hence, the fixing of the ink tray 30 and the release thereof from the fixing are feasible with simple operation.

Still additionally, since the pressers 40 are located at the left- and right-hand end portions of the ink supplying apparatus 2, the pressers 40 do not constitute the hindrance when the operator approaches the ink supplying apparatus 2, particularly the ink fountain 23. Furthermore, since the lever 42 having the fixing screw 41 is designed to be rotated downwardly, when the ink tray 30 is detached from the ink fountain 23 or placed therein, the ink tray 30 does not interfere with the lever 42. Accordingly, this ink supplying apparatus 2 is capable of facilitating the attachment/detachment of the ink tray 30 to/from the ink fountain 23 and, hence, improve the operational efficiency.

Yet additionally, in this ink supplying apparatus 2, since the arms 43 and 44 are directed upwardly so that the levers 42, 42 tilted downwardly catch the pins 35, 35 to hold the ink tray 30 temporarily; therefore, the operator can shift the ink tray 30 from one hand to the other for easy carrying, thus lessening the burden to be imposed on the operator who handles the ink tray 30.

Moreover, the operator cannot conduct another operation while carrying the ink tray 30 and, hence, cannot do his work according to a high-efficiency program. On the other hand, since the ink tray 30 can temporarily be held immediately after being taken out from the interior of the ink fountain 23, in the meantime, the operator can do various kinds of operations, such as the cleaning of the interior of the ink fountain 23 and the cleaning of the ink tray 30 itself, while handling the ink tray 30, that is, can do his work according to a higher-efficiency program.

Still moreover, if the lever 42 is used as a hooker, the increase in the number of parts is suppressible, thereby restraining the increase in cost.

As described above, according to this ink supplying apparatus 2, the ink tray 30 can be fixed easily and surely into the ink fountain 23 and easy attachment/detachment of the ink tray 30 are feasible; therefore, the contamination of the interior of the ink fountain 23 is reducible and the labor-saving on the cleaning operation becomes possible, and the ink tray 30 is held temporarily in a manner that the levers 42, 42 are hooked on to the pins 35, 35 of the ink tray 30; hence, the operational efficiency improves considerably at the ink replacement or the like to enhance the productivity.

Incidentally, the present invention is not limited to the above-described embodiment, and the invention covers all changes and modifications of the embodiment herein which do not constitute departures from the spirit and scope of the invention. For example, in the above-described embodiment, although the two arms 43 and 44 parallel with each other are provided in the lever 42 so that the claws 43*a*, 43*b*, 44*a* and 44*b* are hooked on to the pin 46 in a state where the bracket 48 is interposed therebetween, only one arm will do, or it is possible to provide the claws only on the tip sides of the arms.

In addition, in the above-described embodiment, although the restriction of the rotation of the lever 42 is made in a manner that the claws 43*a*, 43*b*, 44*a* and 44*b* of the arms 43 and 44 catch the pin 46, in contrast to this, it is also possible that a claw installed on the supporting base 24 side catches a pin provided on the arm side. That is, as long as the hooking member provided on the lever 42 side is hooked on to the hooked member provided on the supporting base 24 side for arresting the rotation of the lever 42, the construction thereof is not limited to that in the above-described embodiment. Incidentally, in addition to the construction in which a hooking member catches a hooked member, it is also appropriate that the lever 42 itself is equipped with a lock mechanism.

Still additionally, in the above-described embodiment, although the fixing screw 41 is employed as a pressing means so that the bracket 36 is pressed by tightening the fixing screw 41, the concrete construction of the pressing means is not limited to this. For example, it is also acceptable that a plunger with a spring is employed as the pressing means so that the biasing force of the spring presses the bracket 36.

Yet additionally, in the above-described embodiment, although the lever 42 forming a component of the presser 40 for fixing the ink tray 30 in the ink fountain 23 is used as the hooker, it is also possible that a dedicated hooker (for example, a hook), by contrast, is put to use.

What is claimed is:

1. An ink supplying apparatus which supplies an ink from an ink fountain to an ink fountain roller, said apparatus comprising:

an ink tray set detachably in the interior of said ink fountain, said ink fountain having brackets provided at its left- and right-hand end portions, said brackets mounted on side plates constituting left- and right-hand side walls of said ink fountain;

a stopping section provided in said ink fountain to come into contact with a front end portion of said ink tray for stopping said ink tray; and a fixing device provided in front of said ink fountain for pressing each of said brackets against said stopping section to fix said ink tray in said ink fountain, said fixing device including:

a supporting member placed under a mounting plane of each said bracket;

a rotating member made to be rotatable in a plane substantially perpendicular to a cross direction of said apparatus in a state where its one end portion is supported by said supporting member;

pressing means provided on said rotating member for pressing said bracket in a state where said rotating member rotates upwardly so that said ink tray is fixed in said ink fountain; and arresting means for arresting the rotation of said rotating member when said pressing means presses each said bracket.

2. An ink supplying apparatus according to claim 1, wherein said arresting means comprises:

a hooking member placed on said rotating member; and a hooked member placed on an upward rotating locus of said rotating member, with the rotation of said rotating member being arrested in a manner that said hooking member catches said hooked member at upward rotation of said rotating member.

3. An ink supplying apparatus according to claim 2, wherein an elongated hole is made in said supporting member so that a supporting shaft set at one end portion of said rotating member is supported rotatably by said elongated hole, and a claw is used as said hooking member while a pin is used as said hooked member so that said claw catches said pin in a manner that said rotating member is driven to slide along said elongated hole while being rotated upwardly on said supporting shaft.

4. An ink supplying apparatus according to claim 3, wherein a screw is used as said pressing means so that each said bracket is pressed by a tip portion of said screw when said screw is tightened.

5. An ink supplying apparatus which supplies an ink from an ink fountain to an ink fountain roller, said apparatus comprising:

an ink tray set detachably in the interior of said ink fountain and equipped with a pin protrusively formed on each of its left- and right-hand end portions; and a hooker installed on an operating space side in front of said ink fountain for catching said pin to temporarily hold said ink tray exterior to said ink fountain.

6. An ink supplying apparatus according to claim 5, wherein, in front of said ink fountain, a fixing device is provided which comprises a engaging member engaging/disengaging with/from said pin and which engages said engaging member with said pin to fix said ink tray in the interior of said ink fountain, and said engaging member functions as said hooker when said engaging member is disengaged from said pin.

7. An ink supplying apparatus according to claim 6, wherein said ink tray is set in the interior of said ink fountain, said ink fountain including brackets set on its left- and right-hand end portions, said brackets mounted on side plates constituting left- and right-hand side walls of said ink fountain, and a supporting member is placed under a mounting plane of each of said brackets, with said engaging member being rotated in a plane substantially perpendicular to a cross direction of said apparatus in a state where one end portion of said engaging member is supported by said supporting member, and said engaging member engages with said pin when said engaging member is rotated upwardly, while functioning as said hooker when said engaging member is rotated downwardly.

* * * * *